US009249753B2

(12) United States Patent
Viereck

(10) Patent No.: US 9,249,753 B2
(45) Date of Patent: Feb. 2, 2016

(54) METHOD FOR OPERATING AN INTERNAL COMBUSTION ENGINE

(75) Inventor: Markus Viereck, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 437 days.

(21) Appl. No.: 13/885,116

(22) PCT Filed: Oct. 12, 2011

(86) PCT No.: PCT/EP2011/067799
§ 371 (c)(1),
(2), (4) Date: Jul. 30, 2013

(87) PCT Pub. No.: WO2012/062522
PCT Pub. Date: May 18, 2012

(65) Prior Publication Data

US 2013/0304353 A1 Nov. 14, 2013

(30) Foreign Application Priority Data

Nov. 11, 2010 (DE) ..... 10 2010 043 755

(51) Int. Cl.
*F02D 41/38* (2006.01)
*F02D 41/04* (2006.01)
*F02D 45/00* (2006.01)
(Continued)

(52) U.S. Cl.
CPC ..... *F02D 45/00* (2013.01); *F02D 41/12* (2013.01); *F02D 41/1401* (2013.01); *F02D 41/3836* (2013.01); *F02D 41/3863* (2013.01); *F02D 41/045* (2013.01); *F02D 41/3809* (2013.01);
(Continued)

(58) Field of Classification Search
CPC ..... F02D 41/3836; F02D 41/3872; F02D 41/3863; F02D 41/12; F02D 41/045; F02D 41/1401; F02D 2041/389; F02D 2041/3872; F02D 45/00
USPC ..... 123/458, 493, 447, 456
See application file for complete search history.

(56) References Cited

U.S. PATENT DOCUMENTS 5,727,525 A * 3/1998 Tsuzuki ..... F02M 47/027 123/447
6,714,853 B2 3/2004 Geyer et al.
(Continued)

FOREIGN PATENT DOCUMENTS

CN 101328842 A 12/2008
DE 197 38 502 3/1999
(Continued)

OTHER PUBLICATIONS

International Search Report, International Application No. PCT/EP2011/067799, dated May 11, 2012.

*Primary Examiner* — Lindsay Low
*Assistant Examiner* — George Jin
(74) *Attorney, Agent, or Firm* — Kenyon & Kenyon LLP

(57) ABSTRACT

A method for operating an internal combustion engine is described. The internal combustion engine includes a high-pressure accumulator and a low-pressure area. The high-pressure accumulator and the low-pressure area are connected via a pressure control valve. An open position of the pressure control valve is a function of a control pressure. A negative load change of the internal combustion engine is detected. The control pressure is reduced at a point in time from a starting level to a low level as a function of the detection of a negative load change.

9 Claims, 3 Drawing Sheets

(51) Int. Cl.
*F02D 41/12* (2006.01)
*F02D 41/14* (2006.01)

(52) U.S. Cl.
CPC . *F02D 2041/1409* (2013.01); *F02D 2041/1432* (2013.01)

(56) References Cited

U.S. PATENT DOCUMENTS

2003/0023366 A1* 1/2003 Geyer ..... F02D 41/3836 701/104
2005/0252491 A1* 11/2005 Oono ..... F02B 17/005 123/447
2007/0079808 A1* 4/2007 Takahashi ..... F02D 41/221 123/447
2009/0188469 A1* 7/2009 Tsukada ..... F02D 41/3863 123/456
2011/0125387 A1* 5/2011 Suzuki ..... F02D 41/126 701/103
2012/0166063 A1* 6/2012 Dolker ..... F02D 41/1401 701/102

FOREIGN PATENT DOCUMENTS

DE 101 31 783 1/2003
DE 103 52 005 6/2005
DE 102008035985 A1 2/2010
EP 1 273 780 1/2003

* cited by examiner

METHOD FOR OPERATING AN INTERNAL COMBUSTION ENGINE

FIELD

The present invention relates to a method for operating an internal combustion engine.

BACKGROUND INFORMATION

The fuel pressure in the high-pressure accumulator should be controlled for operating an internal combustion engine having a high-pressure accumulator. Conventional internal combustion engines have a fuel-conducting connection between the high-pressure accumulator and a low-pressure area, which may be opened or closed via a pressure control valve.

The pressure control valve may be operated in a customary operating mode, i.e., in a pressure regulation operation, in a purely controlled manner. The control is designed in such a way that the pressure control valve, per se, always remains closed.

Furthermore, pressure overshoots may occur in the previously named controls or regulations, the pressure overshoots being considered to be undesirable pressure deviations. For example, negative load changes may result in an undesirable overshoot. German Patent Application No. DE 101 31 783 A1 describes a method for stabilizing the fuel pressure.

SUMMARY

Many features used for the present invention are described below and shown in the figures. The features may be important for the present invention both alone and in different combinations without explicit reference being made thereto again.

An example method according to the present invention advantageously generates a control pressure for the pressure control valve as a function of a detection of a negative load change. By reducing the control pressure of the pressure control valve from a starting level to a low level, an undesirable positive pressure deviation may be advantageously prevented, since fuel flows off via the pressure control valve and the pressure within the high-pressure accumulator is thus reduced in a controlled manner.

The control pressure is reduced proactively with regard to a possible, undesirable positive pressure deviation in such a way that potential delays due to hydraulic processes in the high-pressure pump are advantageously avoided. In this way, the pressure reduction in the high-pressure accumulator may be influenced more accurately and the pressure regulation may be assisted. Accordingly, a load on components of the internal combustion engine is reduced and therefore the service life of the components as well as of the entire internal combustion engine is increased. In this way, the components may also be designed in such a way that they are protected against undesirable positive pressure deviations. There are also acoustic advantages, since the method results in a more quiet operation of the internal combustion engine during negative load transitions.

In one advantageous specific embodiment of the method, the injection quantity is reduced simultaneously with the control pressure reduction. This advantageously allows a continuation of the injections at a reduced fuel quantity, whereby fuel is saved and an undesirable positive pressure deviation is prevented at the same time.

In one advantageous specific embodiment of the method, the control pressure remains at the low level for a time period from one point in time to another point in time and the control pressure returns approximately to the starting level at the other point in time. In this way, it is advantageously achieved that the pressure control valve is operated in an "overdriven" manner only during the above-named time period. This results in the pressure control valve being open at least temporarily, so that fuel may flow from the high-pressure accumulator into the low-pressure area, this pressure reduction thus preventing an undesirable positive pressure deviation.

In one advantageous refinement of the method, the return of the control pressure approximately to the starting level is carried out in the form of a ramp function. The ramp function converts a first input value into a second input value over a certain time period. In this way, negative effects on the current or voltage signal which is supplied to the pressure control valve and generated by a signal converter or a current regulation may advantageously be prevented.

In another advantageous specific embodiment of the method, the control pressure transitions into a descending characteristic after the reduction. It is made possible solely by reducing the control pressure that the pressure control valve opens. It is ensured by the continued descending characteristic that the pressure control valve is operated in such a way that no undesirable positive pressure deviations occur.

In another advantageous specific embodiment of the method, the reduction of the control pressure is generated with the aid of a unit, the unit including a phase-ascending differentiating element. Since the inductivity of the pressure control valve delays the opening of the same, the phase-ascending differentiating element ensures that the control pressure is essentially changed in relation to the rate of change of a supplied difference. The phase-ascending differentiating element thus partially compensates for the delay due to the inductivity of the pressure control valve and therefore ensures that the pressure control valve may respond more rapidly and therefore, proactively with regard to an undesirable positive pressure deviation, may be opened more rapidly.

Additional features, possible applications, and advantages of the present invention may be derived from the description of exemplary embodiments of the present invention below, which are illustrated in the figures. All features described or illustrated represent the object of the present invention alone or in any arbitrary combination, regardless of their recapitulation in the patent claims or their back-references, and regardless of their wording in the description or illustration in the figures. The same reference numerals are used for functionally equivalent variables in all figures, even in different specific embodiments.

Exemplary specific embodiments of the present invention are explained below with reference to the figures.

DETAILED DESCRIPTION OF EXAMPLE EMBODIMENTS

Figure 1:
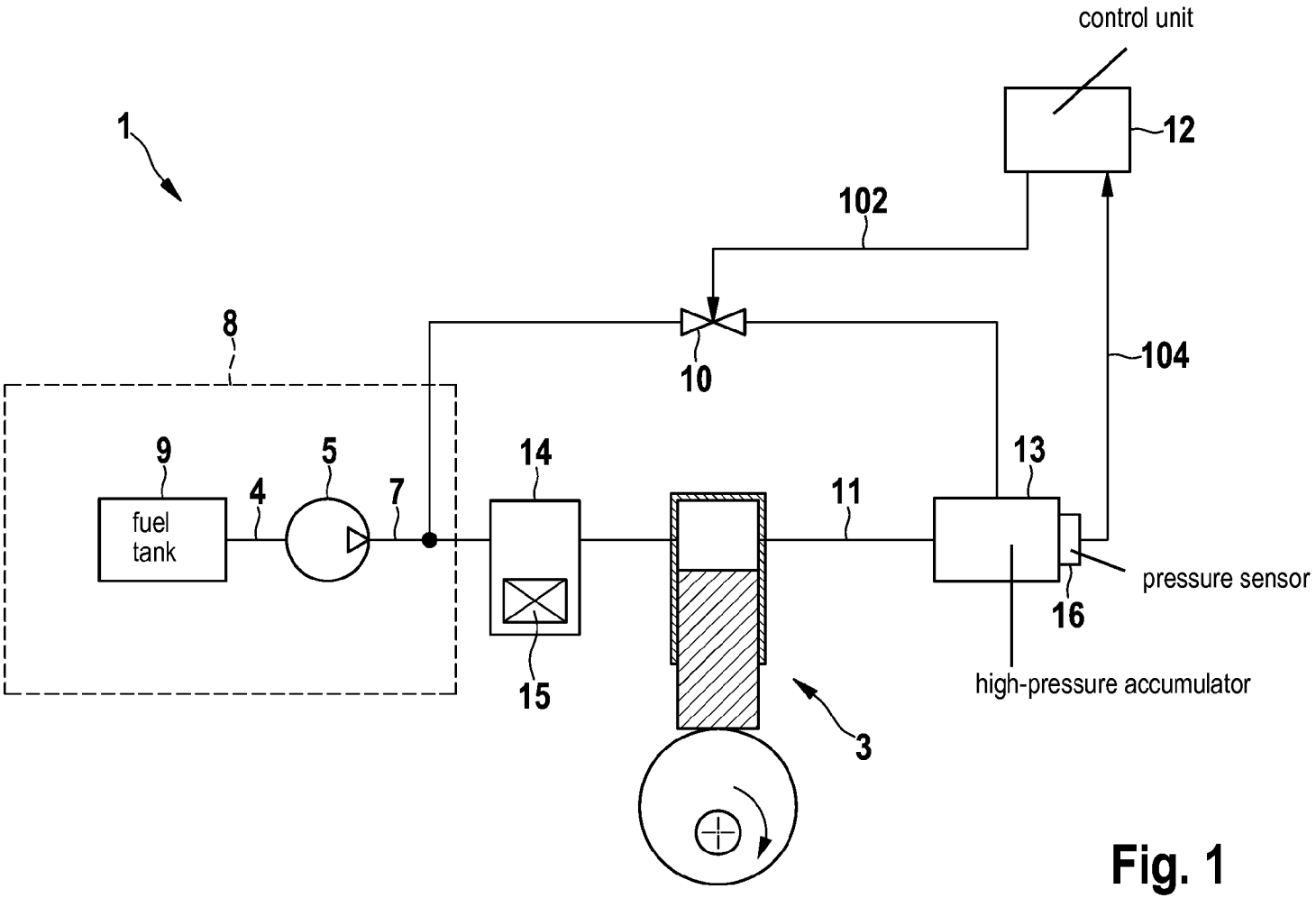
FIG. 1 shows a simplified diagram of a fuel injection system of an internal combustion engine.

FIG. 1 shows a fuel injection system 1 of an internal combustion engine in a heavily simplified illustration. A fuel tank 9 is connected to a high-pressure pump 3 (not explained in greater detail) via an intake line 4, a pre-feed pump 5, and a low-pressure line 7. A high-pressure accumulator 13 (common rail) is connected to high-pressure pump 3 via a high-pressure line 11. A metering unit 14—referred to in the following as MU—having an actuator 15 is situated hydraulically in the course of low-pressure line 7 between pre-feed pump 5 and high-pressure pump 3. Other elements, such as valves of high-pressure pump 3, are not shown in FIG. 1. It is understood that MU 14 and high-pressure pump 3 may be designed as one unit. For example, an inlet valve of high-pressure pump 3 may be forced open by MU 14.

When operating fuel injection system 1, pre-feed pump 5 conveys fuel from fuel tank 9 into low-pressure line 7, and high-pressure pump 3 conveys the fuel into high-pressure accumulator 13. MU 14 thereby determines the fuel quantity supplied to high-pressure pump 3.

High-pressure accumulator 13 is associated with a pressure sensor 16 which generates an actual pressure 104. Actual pressure 104 is supplied to a control unit 12.

High-pressure accumulator 13 is connected to low-pressure line 7 via a pressure control valve 10 which is referred to in the following as PCV. This means that high-pressure accumulator 13 is connected to a low-pressure area 8 of fuel injection system 1. An actuating signal 102 is supplied to PCV 10, actuating signal 102 being generated by control unit 12.

When PCV 10 is open, fuel is able to flow from high-pressure accumulator 13 into low-pressure line 7 or low-pressure area 8 due to the pressure difference between high-pressure accumulator 13 and low-pressure area 8. In a not-illustrated manner, PCV 10 may also be connected to fuel tank 9 or intake line 4.

Figure 2:
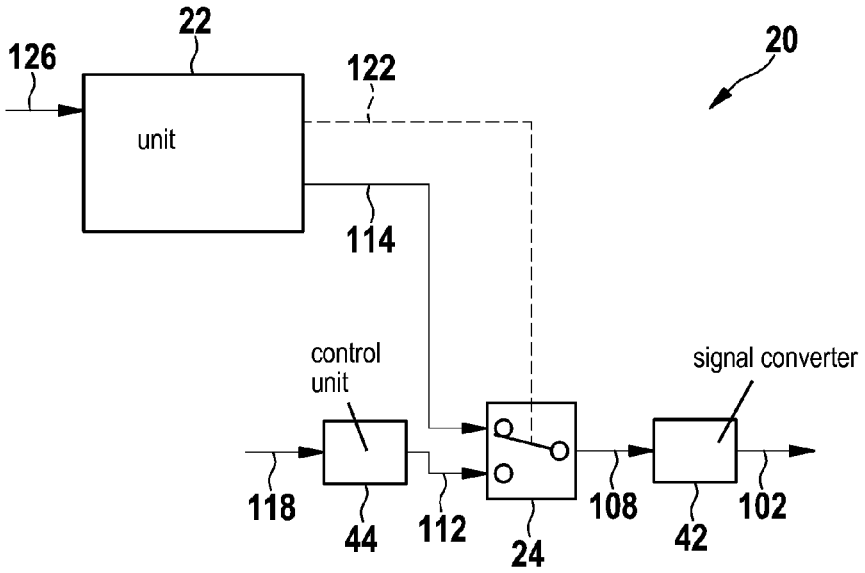
FIG. 2 shows a schematic block diagram for ascertaining a control pressure.

FIG. 2 shows a schematic block diagram 20 for ascertaining a control pressure 108 for actuating signal 102. Schematic block diagram 20 is part of control unit 12 from FIG. 1.

A signal 118 is supplied to a control unit 44. Control unit 44 ascertains a signal 112. Signal 112 is supplied to a switch 24. A signal 114 is also supplied to switch 24. Via signal 122, which is also supplied to switch 24, it is determined which of signals 112 and 114 is supplied to a signal converter 42 as control pressure 108. Signal converter 42 generates actuating signal 102 which is supplied to PCV 10 from FIG. 1. Control pressure 108 thus influences the open position of pressure control valve 10 from FIG. 1. Signal converter 42 may furthermore include current and/or voltage controls and/or regulations.

Control unit 44 generates signal 112 in such a way that PVC 10 from FIG. 1 remains completely closed during the transfer of signal 112 as control pressure 108 by switch 24. Signal 118 may, for example, be a setpoint or an actual pressure, or the like.

Signals 114 and 122 are generated by a unit 22. In the shown state of switch 24, signal 114 is supplied to signal converter 42 as control pressure 108. Signal 122 and signal 114 are formed as a function of a negative load change of the internal combustion engine. For this purpose, unit 22 is acted on by a signal 126, signal 126 signaling a negative load change of the internal combustion engine.

Signal 114 is formed in such a way that PCV 10 opens during the transfer of signal 114 as control pressure 108, and fuel is able to flow from high-pressure accumulator 13 into low-pressure area 8. For this purpose, signal 114 is usually set to a lower value than signal 112. Unit 22 may also be acted on (not illustrated) by a rotational speed, an injection quantity, or another variable with regard to the internal combustion engine to determine signal 114 and/or signal 122 as a function of the corresponding variable.

Signal 114 and signal 122 may be ascertained based on a piece of predictive pressure information. Other parameters may be taken into account for this ascertainment, such as dead time of the high-pressure pump, the high-pressure volume, the compressibility of the fuel, or the quantity flows which flow into and out of high-pressure accumulator 13. For such an ascertainment, unit 22 is provided with inputs (not shown).

Signal 112 and signal 114 are, for example, designed as a pressure signal and control pressure, respectively, or may accordingly be designed to control PCV 10 according to a current/voltage plane.

In a not-illustrated manner, switch 24 may be designed in such a way that a ramp function is used when switching over from signal 112 to 114 or when switching over from signal 114 to signal 112; this ramp function ensures that control pressure 108 is not increased or reduced abruptly from one level to another.

Figure 3:
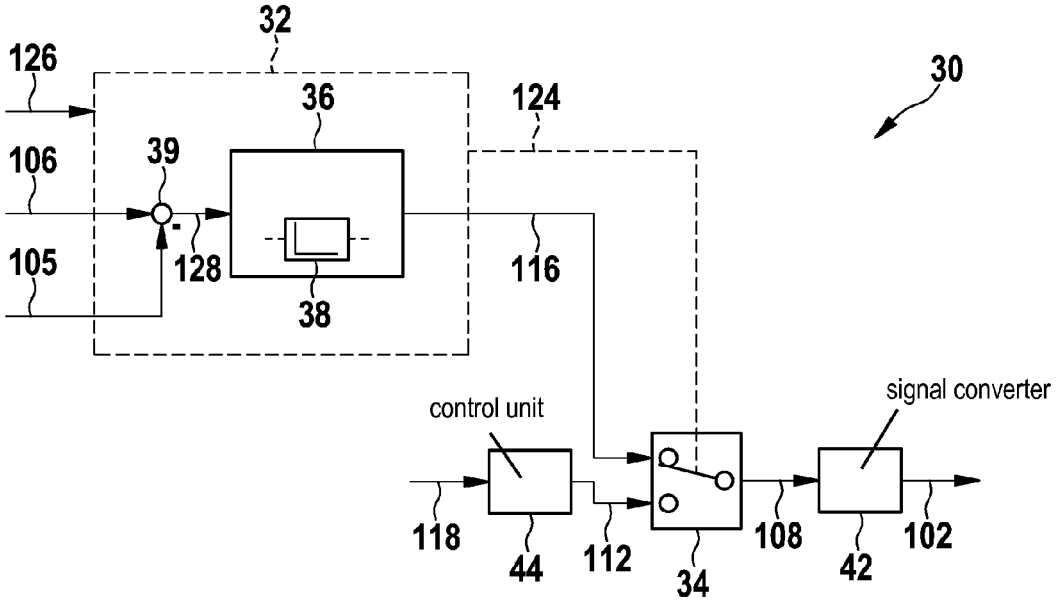
FIG. 3 shows a schematic block diagram for alternatively ascertaining a control pressure.

FIG. 3 shows a schematic block diagram 30 for alternatively ascertaining control pressure 108 for actuating signal 102. Schematic block diagram 30 is part of control unit 12 from FIG. 1. Signal converter 42 and control unit 44 from FIG. 2 are shown.

Similarly to switch 24, there is a switch 34 between signal converter 42 and control unit 44. Switch 34 has the same functions as switch 24. Switch 34 is supplied with a signal 116 and a signal 124 in addition to signal 112.

Signals 116 and 124 are generated by a unit 32. Similarly to unit 22 from FIG. 2, unit 32 is acted on by signal 126. Unit 32 has a unit 36, unit 36 generating signal 116 and being acted on by a difference 128. Difference 128 is generated by subtracting an actual signal 105 from a setpoint signal 106 at a point 39. In a not-illustrated form, difference 128 may also be generated by subtracting setpoint signal 106 from actual signal 105. Unit 36 includes a phase-ascending differentiating element 38. Unit 36 may be a control unit or a regulation unit. Phase-ascending differentiating element 38 ensures that signal 116 generated by unit 36 responds rapidly or abruptly to changes of difference 128. Unit 32 may also be acted on (not illustrated) by a rotational speed, an injection quantity, or another variable with regard to the internal combustion engine to determine signal 116 and/or signal 124 as a function of the corresponding variable.

In a not-illustrated manner, unit 36 may also be designed without a phase-ascending differentiating element 38. The signal generated by unit 36 would then, however, not respond as rapidly to changes of difference 128. This would be advantageous if the dynamization by phase-ascending differentiating element 38, as a function of the system, was not necessary to achieve the desirable pressure characteristic.

For example, actual signal 105 may be control pressure 108 and setpoint signal 106 may be a target control pressure.

Alternatively, actual signal 105 is, for example, an actual volume flow through PCV 10, and setpoint signal 106 is a setpoint volume flow through PCV 10, a dead quantity of high-pressure pump 3 being able to be discharged. The actual volume flow may be measured or estimated from present variables in the control unit.

Alternatively, actual signal 105 is, for example, actual pressure 104 from FIG. 1, and setpoint signal 106 is a setpoint pressure.

Alternatively, actual signal 105 is, for example, an actual pressure or an actual pressure gradient, the actual pressure or the actual pressure gradient being possibly obtained from a predictive estimation. Accordingly, setpoint signal 106 is a corresponding setpoint pressure or setpoint pressure gradient.

In this way, certain future pressure levels may be detected in advance and prevented with the aid of appropriate countermeasures.

Difference 128 may be used by unit 36 to influence the closing process of the PCV, insofar as it is the difference from a setpoint pressure for high-pressure accumulator 13 and actual pressure 104. If too little pressure, i.e., a positive difference 128, is determined during the generation of difference 128 according to FIG. 3, difference 128 results in a rapid closing. If excess pressure, i.e., a negative difference 128, is determined, the difference results in a slow closing.

Signal 116 and/or signal 124 of FIG. 3 or signal 114 and/or signal 122 of FIG. 2 may be ascertained based on a piece of predictive pressure information. Other parameters may be taken into account for the ascertainment of signal 116 and/or 124 or signal 114 and/or signal 122, such as dead time of the high-pressure pump, the high-pressure volume, the compressibility of the fuel, or the quantity flows which flow into and out of high-pressure accumulator 13. For such an ascertainment, unit 32 and unit 22 are provided with appropriate inputs (not shown).

Figure 4:
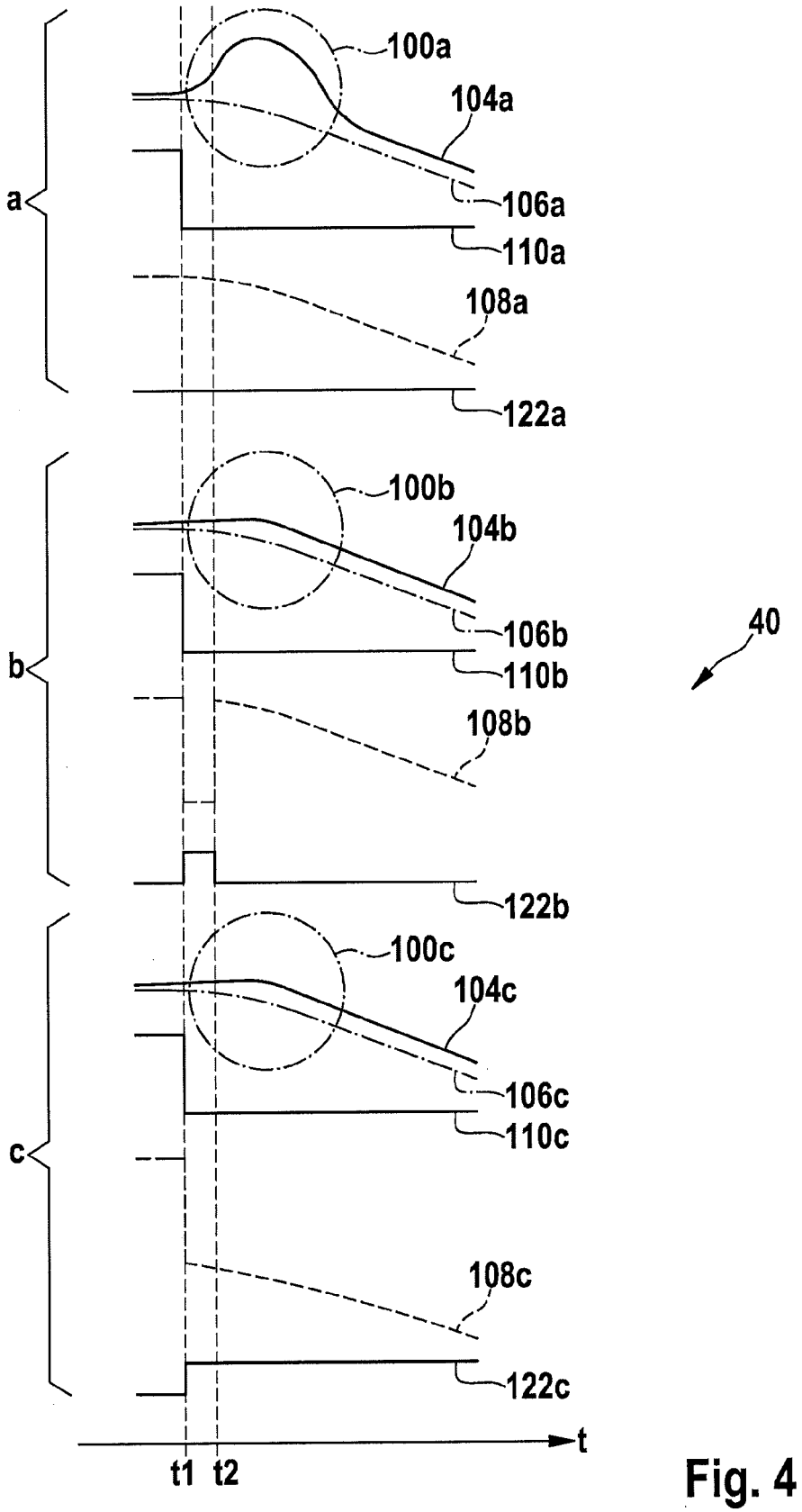
FIG. 4 shows a schematic diagram having three sections, each having different characteristics of the control pressure.

FIG. 4 shows a schematic diagram 40 having three sections a, b, and c, different characteristics of control pressure 108 being illustrated in each case which influence the characteristic of actual pressure 104. A time axis t is shown, two points in time t1 and t2 being plotted against time axis t.

PCV 10 is closed in section a. Section a thus corresponds to the transfer of signal 112 as control pressure 108 in FIGS. 2 and 3. Control pressure 108 is only controlled in this case.

In section a, a setpoint pressure 106*a* drops starting from point in time t1. Prior to or at point in time t1, a negative load change is detected which subsequently requires a decreasing injection quantity. An actual pressure 104*a* does not follow predefined setpoint pressure 106*a*, but starts rising at point in time t1 and approaches the characteristic of setpoint pressure 106*a* again only after leaving marking 100*a*. The characteristic of actual pressure 104*a* at marking 100*a* represents an undesirable positive pressure deviation and thus a pressure overshoot.

An injection quantity 110*a*, which is injected from high-pressure accumulator 13 into cylinders of the internal combustion engine, drops abruptly at point in time t1, i.e., starts decreasing at point in time t1. Control pressure 108*a* also starts dropping at point in time t1. However, the drop of control pressure 108*a* does not necessarily result in the opening of PCV 10. Signal 122*a* remains constant and signal 112 is transferred by switches 24 and 34 as control pressure 108. In sections b and c, signals 114 and 116 are transferred as control pressure 108. In this way, PCV 10 is reliably opened at least temporarily and fuel is able to flow from high-pressure accumulator 13 into low-pressure area 8 of the internal combustion engine. The corresponding pressure reduction may be read off in the characteristics of a setpoint pressure 104*b* and an actual pressure 104*c*.

In section b, a control pressure 106*b* drops starting from point in time t1. Actual pressure 104*b* has a delayed drop compared to setpoint pressure 106*b*. When compared to section a, actual pressure 104*b* in section b has no or only a slight undesirable positive pressure deviation at marking 100*b*. Injection quantity 110*b* drops abruptly at point in time t1 or starts decreasing approximately at point in time t1 (not shown).

Control pressure 108*b* is at a starting level prior to point in time t1. Control pressure 108*b* drops abruptly at point in time t1 and is then at a low level. Control pressure 108*b* abruptly rises again at point in time t2 after a time period has elapsed, in order to return to the previous value of the characteristic of control pressure 108*a*, i.e., to the starting level, the instantaneously valid value of signal 112. The starting level and the low level each includes a range of values, the starting value being above the low value. The previously named time period between points in time t1 and t2 is ascertained as a function of the rotational speed of the internal combustion engine. The low level is ascertained as a function of the rotational speed of the internal combustion engine. Furthermore, the changes in the injection quantity and other factors may influence the low level.

Signal 122*b* increases at point in time t1 and abruptly decreases at point in time t2. According to signal 122*b*, signal 112 is selected as control pressure 108 by switches 24 and 34 prior to point in time t1. According to signal 122*b*, which corresponds to signal 122 or 124 in FIG. 2 or 3, signals 114 and 116 are selected as control pressure 108 by switches 24 and 34, respectively, between points in time t1 and t2. According to signal 122*b*, signal 112 is selected as control pressure 108 by switches 24 and 34 as control pressure 108 after point in time t2.

According to the characteristic of control pressure 108*b*, it is possible that PCV 10 opens temporarily to discharge enough fuel from high-pressure accumulator 13 so that no or only a slight positive pressure deviation of actual pressure 104*b* occurs compared to marking 100*a*.

In section c, a setpoint pressure 106*c* drops starting after point in time t1. Likewise, actual pressure 104*c* drops, but with a delay with regard to setpoint pressure 106*c*. At marking 100*c*, actual pressure 104*c* has no or only a slight undesirable positive pressure deviation compared to marking 100*a*. Injection quantity 110*c* drops abruptly at point in time t1. Control pressure 108*c* drops abruptly at point in time t1 and has a descending characteristic after that. [The characteristic of] signal 122*c* increases abruptly at point in time t1. Likewise, a constant value may essentially be maintained after the abrupt drop instead of the descending characteristic of control pressure 108*c*.

According to signal 122*c*, which corresponds to signal 122 or 124 in FIG. 2 or 3, switches 24 and 34 select signal 112 to be transferred as control pressure 108*c*, prior to point in time t1. According to signal 122*c*, switches 24 and 34 select signals 114 and 116 to be transferred as control pressure 108*c*, after point in time t1.

The characteristic of control pressure 108*c* results in PCV 10 opening at least temporarily so that fuel may flow from high-pressure accumulator 13 into low-pressure area 8 and an undesirable pressure deviation, in particular an undesirable positive deviation of actual pressure 104*a* at marking 100*a*, may be avoided or reduced.

Actuating signal 102 is usually a current or voltage signal. Signals 122, 124, 122*a*, 122*b* and 122*c* are usually digital signals, but they may also be designed to carry out a ramping in or ramping out of the input signals of switches 24 and 34 in other contexts. Accordingly, switches 24 and 34 may be designed for a ramping in or ramping out.

Actual pressures 104*a*, 104*b*, and 104*c* are in general referred to as actual signals. Setpoint pressures 106*a*, 106*b*, and 106*c* are in general referred to as setpoint signals.

What is claimed is:

1. A method for operating an internal combustion engine, the internal combustion engine including a high-pressure accumulator and a low-pressure area, the high-pressure accumulator and the low-pressure area being connected via a pressure control valve, an open position of the pressure control valve being a function of a control pressure, the method comprising:

detecting a negative load change of the internal combustion engine;

reducing the control pressure at a point in time from a starting level to a low level as a function of the detection of a negative load change, the control pressure remaining at the low level for a time period from the point in time to another point in time; and returning the control pressure approximately to the starting level at the other point in time, a time period between the point in time and the other point in time being ascertained as a function of a rotational speed of the internal combustion engine.

2. The method as recited in claim 1, wherein almost at the same point in time of the reduction of the control pressure, an injection quantity of the internal combustion engine is reduced.

3. The method as recited in claim 1, wherein the reduction of the control pressure from the starting level to at least one of the low level and return of the control pressure approximately to the starting level, is carried out in the form of a ramp function.

4. The method as recited in claim 1, wherein the low level of the control pressure is ascertained as a function of the rotational speed of the internal combustion engine.

5. The method as recited in claim 1, wherein after the reduction, the control pressure transitions into a descending characteristic, and an absolute value of a gradient of the descending characteristic is lower than an absolute value of a gradient of the reduction.

6. The method as recited in claim 1, wherein the reduction of the control pressure is generated with the aid of a unit, and the unit includes a phase-ascending differentiating element.

7. The method as recited in claim 6, wherein the unit is supplied with a difference, and the difference is formed from one of a subtraction of an actual signal from a setpoint signal or from a subtraction of a setpoint signal from an actual signal.

8. A control unit for operating an internal combustion engine, the internal combustion engine including a high-pressure accumulator and a low-pressure area, the high-pressure accumulator and the low-pressure area being connected via a pressure control valve, an open position of the pressure control valve being a function of a control pressure, the control unit configured to detect a negative load change of the internal combustion engine, to reduce the control pressure at a point in time from a starting level to a low level as a function of the detection of a negative load change, the control pressure remaining at the low level for a time period from the point in time to another point in time, and to return the control pressure approximately to the starting level at the other point in time, a time period between the point in time and the other point in time being ascertained as a function of a rotational speed of the internal combustion engine.

9. An internal combustion engine for a motor vehicle, the internal combustion engine including a high-pressure accumulator and a low-pressure area, the high-pressure accumulator and the low-pressure area being connected via a pressure control valve, an open position of the pressure control valve being a function of a control pressure, and a control unit configured to detect a negative load change of the internal combustion engine, to reduce the control pressure at a point in time from a starting level to a low level as a function of the detection of a negative load change, the control pressure remaining at the low level for a time period from the point in time to another point in time, and to return the control pressure approximately to the starting level at the other point in time, a time period between the point in time and the other point in time being ascertained as a function of a rotational speed of the internal combustion engine.

* * * * *